US005699596A

United States Patent [19]

Fehrer

[11] Patent Number: 5,699,596

[45] Date of Patent: Dec. 23, 1997

[54] APPARATUS FOR NEEDLING A FIBROUS WEB

[76] Inventor: Ernst Fehrer, Auf der Gugl 28, A-4020 Linz, Austria

[21] Appl. No.: 729,487

[22] Filed: Oct. 11, 1996

[30] Foreign Application Priority Data

| | | | |
|---|---|---|---|
| Oct. 16, 1995 | [AT] | Austria | A 1713/95 |
| Dec. 11, 1995 | [AT] | Austria | A 2001/95 |
| Feb. 6, 1996 | [AT] | Austria | A 212/96 |

[51] Int. Cl.[6] ..... D04H 18/00

[52] U.S. Cl. ..... 28/115; 28/107

[58] Field of Search ..... 28/107, 111, 115, 28/116, 117, 103, 105

[56] References Cited

U.S. PATENT DOCUMENTS

| | | | |
|---|---|---|---|
| 4,047,269 | 9/1977 | Lochner | 28/111 |
| 5,016,331 | 5/1991 | Dilo | 28/115 |
| 5,528,805 | 6/1996 | Leuchtenmuller et al. | 28/115 |
| 5,567,678 | 10/1996 | Fehrer | 28/115 |

FOREIGN PATENT DOCUMENTS

| | | |
|---|---|---|
| 263395 | 10/1967 | Austria . |
| 361721 | 8/1980 | Austria . |
| 2131385 | 12/1972 | Germany . |
| 2264257 | 11/1973 | Germany . |

*Primary Examiner*—C. D. Crowder
*Assistant Examiner*—Larry D. Worrell, Jr.
*Attorney, Agent, or Firm*—Collard & Roe, P.C.

[57] ABSTRACT

An apparatus for needling a fibrous web passing through the apparatus in one direction, which comprises a needle board driven back and forth in a needling direction, needles carried by the needle board and extending in the needling direction, and a stationary support opposite the needle board in the needling direction. The stationary support comprises in the range of the needles two support sections inclined in opposite directions in the one direction and a transitional support section between the two support sections and smoothly merging into the two oppositely inclined support sections.

10 Claims, 4 Drawing Sheets

APPARATUS FOR NEEDLING A FIBROUS WEB

BACKGROUND OF THE INVENTION

1. Field of the Invention

The present invention relates to an apparatus for needling a fibrous web passing through the apparatus in one direction, which comprises a needle board driven back and forth in a needling direction, needles carried by the needle board and extending in the needling direction, and a stationary support opposite the needle board in the needling direction.

2. Description of the Prior Art

To enhance the strength of a needled fibrous web, it is known to punch the needles through the web not perpendicularly to the web surface but in a direction opposite to the direction in which the fibrous web is passed through the apparatus. For this purpose, the web guidance defined between the support and a stripper has an inlet section ascending in this direction and an oppositely descending outlet section in the range of the needles. The inlet and outlet sections are connected in a zone in which no needles are provided. Correspondingly, the needle board is roof-shaped and carries vertically oriented needles only in its oppositely inclined sections. These needles punch through the fibrous web in the inlet and outlet sections of the support in directions respectively inclined in, and opposite to, the direction in which the fibrous web passes. The limitation of the needles to the area of the inlet and outlet sections results in a reduced density of the needling, which counteracts the desire of obtaining higher extent of felting. In addition, obtaining a higher web strength in the longitudinal direction of the web is also limited.

SUMMARY OF THE INVENTION

It is a primary object of this invention to overcome these disadvantages and to improve a needling apparatus of the first-described type by simple structural devices so that a high degree of felting and a considerable increase in the longitudinal strength of the needled fibrous web may be achieved.

The above and other objects are accomplished by the invention with a stationary support comprising, in the range of the needles, two support sections inclined in opposite directions in the direction in which the fibrous web passes through the apparatus, and a transitional support section between the two support sections and smoothly merging into the two oppositely inclined support sections.

Since the range of the needles extends not only over the oppositely inclined support sections but also over the connecting transitional support section, a desired number of needles and dense arrangement of the needles may be obtained in a very simple manner. Because of the smooth and steady transition between the differently inclined support sections, the needling direction changes steadily in the one direction because the fibrous web is pressed against the support surface at least during needling. The steady transitions of the inclinations of the support produce needling of the web not only in the areas where the needling directions are most strongly inclined relative to the plane defined by the web but also in the areas where the needling directions are less strongly inclined. This results in a very high degree of felting.

The structure is particularly simple if the support, which is usually a perforated plate, has a steady curvature extending, in the range of the needles, in the one direction in which the fibrous web passes through the apparatus. However, this steady curvature needs not be uniform. To obtain special effects, particularly along the inlet and outlet sections, the curvatures of these sections may differ from each other. A convex curvature is preferred to a concave curvature because it assures that the fibrous web is pressed against the stationary support so that it lies flatly on it as it passes in the one direction so that it is securely guided during needling.

Since the fibrous web is pressed against the surface of the support during needling, the orientation of the needling direction is determined primarily by the inclination of the support surface with respect to the needles. Therefore, in general, the shape of a stripper positioned between the needle board and the stationary support, and of the needle board may be selected independently of the shape of the support as long as the stripper function and the punching depth of the needles is assured. However, it will be usually structurally advantageous if the stripper and possibly the needle board have a curvature conforming to the curvature of the support, the stripper defining a gap with the support for guiding the fibrous web in the one direction. For example, if the shape of the needle board conforms to that of the support, needles of equal length may be used over the entire range of the needles. In addition, the curvature of the needle board increases the strength thereof, which is of particular advantage in needle apparatus wherein a high frequency of the reciprocation of the needle board subjects the needle board to considerable stresses. Because a curved needle board is stronger than a planar one, the reciprocating mass constituting the needle board may be reduced.

The gap between the stripper and the stationary support may advantageously steadily diminish in width in the one direction to provide a guidance for the fibrous web, which takes into account the steadily diminishing thickness of the fibrous web as it progresses in the one direction during needling. This requires a curvature of the stripper differing from the curvature of the support.

If the needle board and the support have the same curvature, all needles will punch into the fibrous web to the same depth. If different punching depths are desired with needles of the same length, such a needle board may be inclined with respect to the support in the one direction. Another possibility for obtaining the same effect is to provide a needle board that has a curvature differing from the curvature of the support. With such a needle board, needles of the same length will punch through the web at different depths.

If the support with its two oppositely inclined sections and the connecting transition section in the range of the needles has a preferred inclination with respect to the needling direction, the strength of the fibrous web in its longitudinal direction may be increased to an unexpected extent. In this case, the web is needled in different needling directions but primarily in a single direction of inclination, i.e. the needles will be inclined either in the direction of the passage of the web, or in a direction opposite thereto. This web needling proceeding asymmetrically relative to the center of the web guidance avoids an otherwise disadvantageous influence between the intersecting needling points and results in an unexpected increase in the strength of the fibrous web. This is of particular advantage in layered fibrous webs because such webs have a preferred layer extending transversely to the longitudinal extension of the web and, therefore, have a transverse strength exceeding their longitudinal strength. With such a preferred inclination relative to the needling direction, the longitudinal strength of the fibrous web may be advantageously adapted to the transverse strength thereof.

If the stationary support has an average inclination declining in the one direction, the needles will punch through the fibrous web with a motion component extending primarily in this one direction to impart a stretch to the web. This is particularly advantageous with layered fibrous webs because it does away with the otherwise required, subsequent stretching of the fibrous web.

To obtain an ascending or descending average inclination of the support in the one direction, its steady curvature may extend eccentrically with respect to a center plane extending in the needling direction and perpendicularly to the one direction.

In another embodiment, the steady curvature has an inclination increasing or decreasing in the one direction. While this permits an advantageous adaptation of the support to different needling requirements under certain circumstances, the manufacture will generally be facilitated with an embodiment of the support in which circularly cylindrical segments are asymmetrically arranged with respect to the center plane.

DETAILED DESCRIPTION OF THE DRAWING

The above and other objects, advantages and features of the present invention will become more apparent in the following detailed description of certain now preferred embodiments thereof, taken in conjunction with the accompanying, partially schematic drawing wherein FIG. 1 is a simplified and fragmentary side elevational view of a needling apparatus according to this invention;

DETAILED DESCRIPTION OF THE PREFERRED EMBODIMENTS

Figure 1:
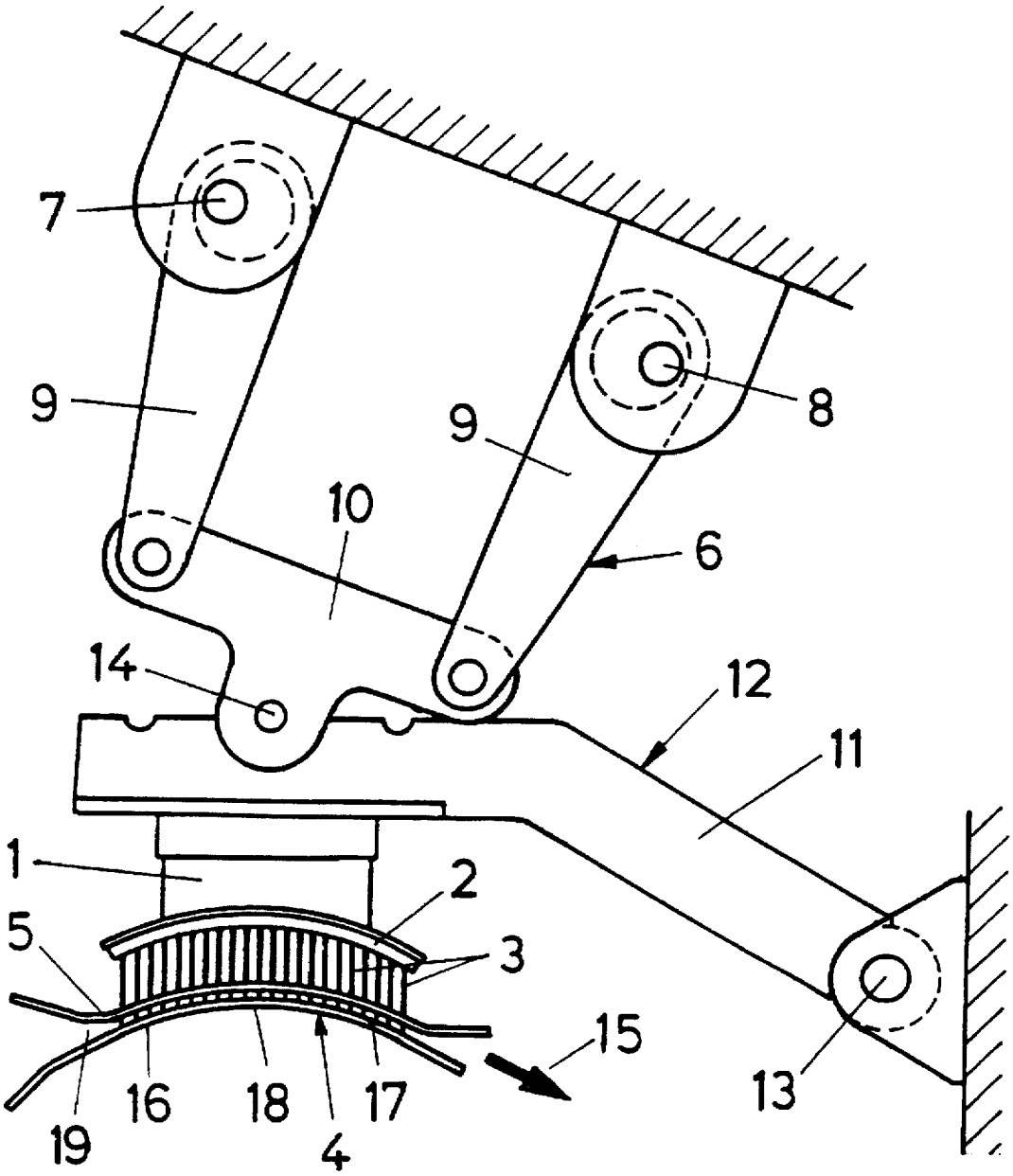
Figure 2:
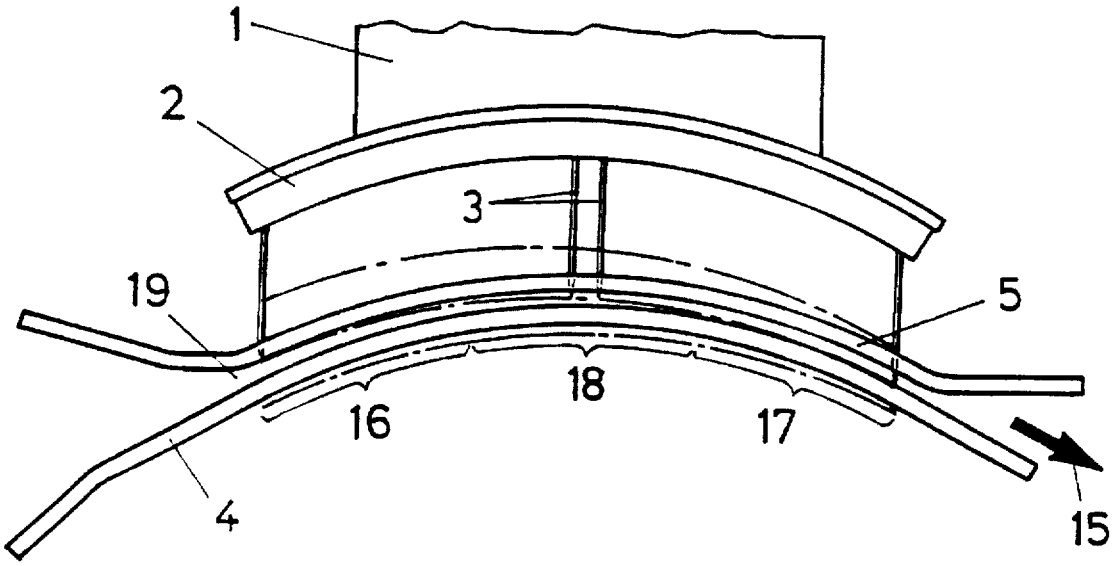
FIG. 2 is a fragmentary and enlarged side elevation view showing the apparatus in the range of the needles.

Referring now to the drawing, wherein like reference numerals refer to like parts operating in a like manner, FIGS. 1 and 2 illustrate an apparatus for needling a fibrous web passing through the apparatus in one direction indicated by arrow 15. The apparatus comprises needle board 2 driven back and forth in a needling direction, needles 3 carried by the needle board and extending in the needling direction, and stationary support 4 opposite needle board 2 in the needling direction. Stripper 5 is positioned between the needle board and the stationary support, and the stripper defines gap 19 with the support for guiding the fibrous web in the one direction so that needles 3 punch through the fibrous web as needle board 2 is reciprocated in the needling direction. Support 4 and stripper 5 are perforated plates, and needles 3 pass through holes in the plates during the needling operation.

Needle board 2 is driven by a sliding crank drive 6 which is comprised of two parallel crank shafts 7, 8 rotating in opposite directions and connecting rods 9 mounted on the crank shafts. The connecting rods are linked together by coupling element 10 to form a quadrilateral linkage, and rocker device 11 consisting of two parallel arms is linked to coupling element 10 at pivot axle 14 at the center of the coupling element. Rocker device 12 is pivotal about axis 13 at one end thereof while its opposite end carries needle beam 1 on which needle board 2 is mounted. In this manner, crank drive 6 reciprocates needle board 2 along an arcuate path extending about pivot axis 13. The rocking motion about pivot axis 13 is accompanied by a tumbling motion of coupling element 10 about pivot axle 14.

In contrast to the conventional guidance of the fibrous web through the needling apparatus, stationary support 4 comprises in the range of needles 3 a steady curvature extending in direction 15 in which the fibrous web passes through the apparatus. This provides two support sections 16, 17 inclined in opposite directions in this direction and transitional support section 18 between the two support sections 16, 17, which smoothly merges into the two oppositely inclined support sections. As can clearly be seen in FIG. 2, support section 16 provides an inlet section ascending in direction 15 while support section 17 provides an outlet section descending in this direction.

The needling apparatus further comprises stripper 5 positioned between needle board 2 and stationary support 4, and the stripper has a curvature conforming to the curvature of the support and defining gap 19 with the support for guiding the fibrous web in direction 15. Thus, the average needling direction of needles 3 punching through the fibrous web as it passes though gap 19 is inclined along support sections 16, 17 in opposite directions with respect to the web in direction 15 while it extends substantially vertically along transitional support section 18. Because of the steady curvature, a smooth transition between the different needling directions is achieved. This assures a substantial strengthening of the fibrous web, particularly in the longitudinal direction of the web without any loss in the transverse strength, compared to needling in a vertical direction.

Gap 19 may steadily diminish in width in direction 15 to take into account the progressive reduction in the thickness of the fibrous web as it is needled during its passage through the gap in this direction. This may be accomplished by keeping the curvature of support 4 constant while the curvature of stripper 5 increases in direction 15.

Needle board 2 may also be curved since the curvature of support 4, stripper 5 and the needle board enhance the strength of these structural parts. The needle board may have a curvature conforming to the curvature of support 4. This permits the use of needles 3 of equal length. However, as shown in FIG. 2, needle board 2 may have a curvature differing from the curvature of support 4. In this case, needles of equal length will punch into the fibrous web in different depths, depending on their location on the needle board. This will produce special needling effects.

Figure 3:
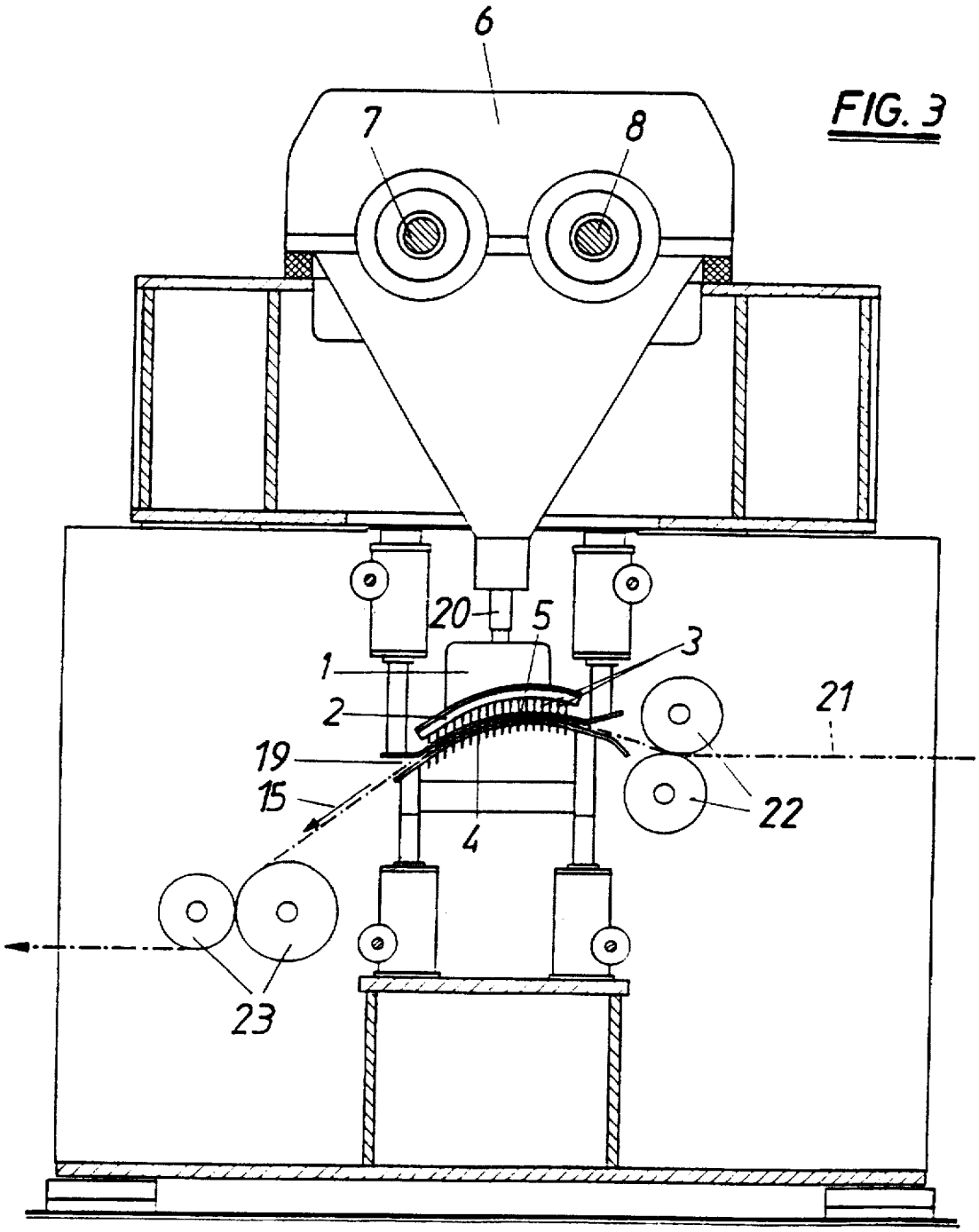
FIG. 3 is a side elevational view of another embodiment of the needling apparatus.
Figure 4:
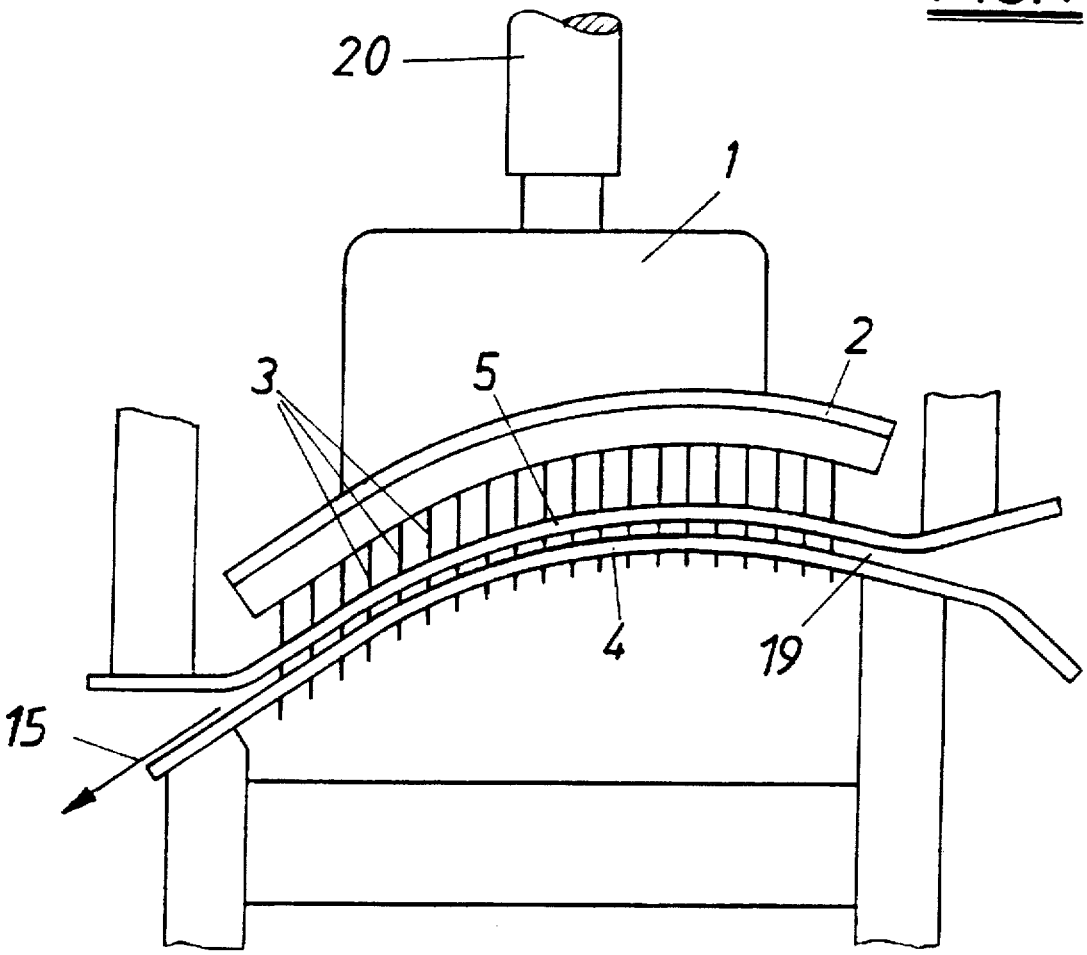
FIG. 4 is a fragmentary and enlarged side elevation view showing the apparatus of FIG. 3 in the range of the needles.

In the embodiment of FIGS. 3 and 4, needle board 2 also is driven by crank drive 6 comprised of two parallel crank shafts 7, 8 driven in opposite directions and two connecting rods which are linked together by a coupling element. However, in this embodiment, needle beam 1 is rectilinearly reciprocated by push rods 20 linked to the coupling element. A pair of driven rolls 22 leads fibrous web 21 into gap 19 between support 4 and stripper 5 and the fibrous web is pulled out of the gap by a pair of driven rolls 23. The inlet and outlet edges of support 4 preferably define a deflecting guide for fibrous web 21 as it enters and leaves gap 19 so that the web lies flat against support 4 along the entire length thereof.

In this embodiment best shown in FIG. 4, the steady curvature of support 4 extends eccentrically with respect to a center plane extending in the needling direction and perpendicularly to direction 15. In the first described embodiment, there is no preferred inclination of support 4 with respect to the needling direction of needles 3 because each needling direction opposite direction 15 is matched by a needling direction in direction 15. On the other hand, in the embodiment of FIGS. 3 and 4, the steady curvature of support 4 has an average inclination increasing in direction 15. This produces a preferred inclination of the needling direction as fibrous web 21 passes in direction 15. This produces a particularly high increase in the longitudinal strength of the fibrous web and also has a stretching effect, which is especially advantageous in the needling of layered fibrous webs.

What is claimed is:

1. An apparatus for needling a fibrous web passing through the apparatus in one direction, which comprises (a) a needle board driven back and forth in a needling direction, (b) needles carried by the needle board, extending in the needling direction and defining a needling path when the needle board is driven back and forth, and (c) a stationary support opposite the needle board in the needling direction, the stationary support comprising in the needling path (1) two support sections inclined in opposite directions in the one direction and (2) a transitional support section between the two support sections, the transitional support section smoothly merging with the two oppositely inclined support sections.

2. The needling apparatus of claim 1, wherein the support has a steady curvature extending in the one direction.

3. The needling apparatus of claim 2, further comprising a stripper positioned between the needle board and the stationary support, the stripper having a curvature conforming to the curvature of the support and defining a gap with the support for guiding the fibrous web in the one direction.

4. The needling apparatus of claim 3, wherein the gap steadily diminishes in width in the one direction.

5. The needling apparatus of claim 2, wherein the needle board has a curvature conforming to the curvature of the support.

6. The needling apparatus of claim 2, wherein the needle board has a curvature differing from the curvature of the support.

7. The needling apparatus of claim 2, wherein the steady curvature extends eccentrically with respect to a center plane extending in the needling direction and perpendicularly to the one direction.

8. The needling apparatus of claim 2, wherein the steady curvature has an inclination increasing in the one direction.

9. The needling apparatus of claim 2, wherein the steady curvature has an inclination decreasing in the one direction.

10. The needling apparatus of claim 1, wherein the stationary support has an average inclination declining in the one direction.

* * * * *